US009845813B2

(12) United States Patent
Shimizu et al.

(10) Patent No.: US 9,845,813 B2
(45) Date of Patent: Dec. 19, 2017

(54) DRIVING DEVICE FOR WORK MACHINE AND WORK MACHINE EQUIPPED THEREWITH

(71) Applicant: Hitachi Construction Machinery Co., Ltd., Tokyo (JP)

(72) Inventors: Juri Shimizu, Tokyo (JP); Kenji Hiraku, Tokyo (JP); Teppei Saitoh, Tokyo (JP); Mariko Mizuochi, Tokyo (JP); Akinori Ishii, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 422 days.

(21) Appl. No.: 14/413,779

(22) PCT Filed: Jul. 3, 2013

(86) PCT No.: PCT/JP2013/068267
§ 371 (c)(1),
(2) Date: Jan. 9, 2015

(87) PCT Pub. No.: WO2014/045672
PCT Pub. Date: Mar. 27, 2014

(65) Prior Publication Data

US 2015/0135697 A1 May 21, 2015

(30) Foreign Application Priority Data

Sep. 20, 2012 (JP) ..... 2012-207142

(51) Int. Cl.
*F15B 11/042* (2006.01)
*E02F 9/22* (2006.01)
*F15B 11/17* (2006.01)
*F15B 11/044* (2006.01)

(52) U.S. Cl.
CPC ..... *F15B 11/0423* (2013.01); *E02F 9/2217* (2013.01); *E02F 9/2228* (2013.01); (Continued)

(58) Field of Classification Search
CPC ..... E02F 9/2217; E02F 9/2228; E02F 9/2235; E02F 9/2242; E02F 9/2289; E02F 9/2292; (Continued)

(56) References Cited

FOREIGN PATENT DOCUMENTS

JP 57-133941 A 8/1982
JP 58-57559 A 4/1983
(Continued)

OTHER PUBLICATIONS

PCT International Preliminary Report on Patentability, dated Mar. 24, 2015, which issued during the prosecution of International Application No. PCT/JP2013/068267, which corresponds to the present application.

*Primary Examiner* — Logan Kraft
(74) *Attorney, Agent, or Firm* — Baker Botts L.L.P.

(57) ABSTRACT

There is provided a driving device for a work machine, having a closed hydraulic circuit system for driving cylinders with hydraulic pumps, the driving device making the speed of operation substantially the same in both directions of piston rod extension and contraction. The driving device includes: a first hydraulic pump that has flow rate control device for controlling the flow rate and direction of hydraulic fluid to be delivered; a single rod hydraulic cylinder that is driven with the hydraulic fluid to drive one of work members of a work device on the work machine; a closed hydraulic circuit that connects the first hydraulic pump with the single rod hydraulic cylinder to form a closed circuit using flow lines through which the hydraulic fluid flows; a branch line that branches from the flow line between the first hydraulic pump and the single rod hydraulic cylinder; a first flow line of which one end is connected to the branch line; a tank to which the other end of the first flow line is connected; and a hydraulic fluid flow rate control device attached to the first flow line to control the flow rate of the hydraulic fluid flowing from the branch line to the tank or from the tank to the branch line.

3 Claims, 4 Drawing Sheets

(52) U.S. Cl.
CPC ..... *E02F 9/2235* (2013.01); *E02F 9/2242* (2013.01); *E02F 9/2289* (2013.01); *E02F 9/2292* (2013.01); *E02F 9/2296* (2013.01); *F15B 11/044* (2013.01); *F15B 11/17* (2013.01); *F15B 2211/20546* (2013.01); *F15B 2211/20561* (2013.01); *F15B 2211/20576* (2013.01); *F15B 2211/27* (2013.01); *F15B 2211/41518* (2013.01); *F15B 2211/41572* (2013.01); *F15B 2211/665* (2013.01); *F15B 2211/6654* (2013.01); *F15B 2211/7053* (2013.01); *F15B 2211/785* (2013.01)

(58) Field of Classification Search
CPC ... E02F 9/2296; F15B 11/024; F15B 11/0423; F15B 11/044; F15B 11/17; F15B 21/14; F15B 2211/20546; F15B 2211/20561; F15B 2211/20576; F15B 2211/27; F15B 2211/41518; F15B 2211/41572; F15B 2211/665; F15B 2211/6654; F15B 2211/7053; F15B 2211/785
See application file for complete search history.

(56) References Cited

FOREIGN PATENT DOCUMENTS

| | | | |
|---|---|---|---|
| JP | 58-102806 | A | 6/1983 |
| JP | 11-141504 | A | 5/1999 |
| JP | 2002-54602 | A | 2/2002 |
| JP | 2004-190845 | A | 7/2004 |
| JP | 2005-76781 | A | 3/2005 |

FIG. 3

| | | | PUMPS | | | VALVES | | | | | | | |
|---|---|---|---|---|---|---|---|---|---|---|---|---|---|
| | | | | | | SELECTOR VALVES | | | | | | PROPORTIONAL SELECTOR VALVES | |
| | | | 9.60 | 10.61 | 11.62 | 25 | 26 | 27 | 37 | 38 | 39 | 30 | 42 |
| NON-OPERATION | 0 | STOPPED STATE | OFF | OFF | OFF | CUT OFF | CUT OFF | CUT OFF | CUT OFF | CUT OFF | CUT OFF | CUT OFF | CUT OFF |
| INDIVIDUAL OPERATION | 1 | BOOM (LOW SPEED) | ON | OFF | OFF | CUT OFF | CUT OFF | CUT OFF | CUT OFF | CUT OFF | CUT OFF | CUT OFF | CUT OFF |
| | 2 | BOOM (HIGH SPEED) | ON | ON | OFF | CUT OFF | CUT OFF | COMMUNI-CATING | CUT OFF | CUT OFF | CUT OFF | CUT OFF | CUT OFF |
| | 3 | ARM CROWDING | OFF | ON | OFF | COMMUNI-CATING | CUT OFF | CUT OFF | CUT OFF | CUT OFF | CUT OFF | COMMUNI-CATING | CUT OFF |
| | 4 | BUCKET DUMPING | OFF | OFF | ON | CUT OFF | CUT OFF | CUT OFF | COMMUNI-CATING | CUT OFF | CUT OFF | CUT OFF | COMMUNI-CATING |
| COMBINED OPERATION | 5 | BOOM (LOW SPEED)/ ARM/BUCKET COMBINED | ON | ON | ON | COMMUNI-CATING | CUT OFF | CUT OFF | COMMUNI-CATING | CUT OFF | CUT OFF | COMMUNI-CATING | COMMUNI-CATING |
| | 6 | BOOM (HIGH SPEED)/ ARM/BUCKET COMBINED | ON | ON | ON | CUT OFF | CUT OFF | COMMUNI-CATING | COMMUNI-CATING | COMMUNI-CATING | CUT OFF | COMMUNI-CATING | COMMUNI-CATING |

DRIVING DEVICE FOR WORK MACHINE AND WORK MACHINE EQUIPPED THEREWITH

TECHNICAL FIELD

The present invention relates to a driving device for a work machine such as a hydraulic excavator and a work machine equipped with the driving device.

BACKGROUND ART

In recent years, development has been underway of a hydraulic circuit (defined as a closed circuit) in a work machine such as a hydraulic excavator, the hydraulic circuit being connected so as to have fewer throttle elements for driving a hydraulic actuator and supply hydraulic fluid from a hydraulic drive source such as a hydraulic pump to the hydraulic actuator before returning the worked hydraulic fluid to the hydraulic drive source without feeding the fluid back to a tank so that the rate of fuel consumption may be lowered.

On many work machines, a single rod type cylinder is used as a hydraulic actuator. In the single rod type cylinder, the pressure-receiving area of the internal piston on the head side is different from that on the rod side. It follows that with the cylinder connected to a closed circuit, driving the piston causes excess or shortage of the flow rate of hydraulic fluid within the circuit. There exists a closed hydraulic circuit furnished with a flushing valve to control such excess or shortage of the flow rate of hydraulic fluid (e.g., see Patent Literature 1).

There is also provided a driving device for a work machine, the driving device being capable of supplying optimum power in accordance with a load and including: a closed circuit that controls the operating speed of a hydraulic pressure actuator connected to a hydraulic pressure pump through variable displacement control of the hydraulic pressure pump of which the flow rate is controlled by variable displacement device; an open circuit that controls the operating speed of the hydraulic pressure actuator connected to a control valve through variable displacement control of the hydraulic pressure pump of which the flow rate is controlled by variable displacement device different from the above variable displacement device that controls the flow rate of the hydraulic pressure pump in the closed circuit and through flow rate control effected by the control valve for controlling hydraulic fluid supplied from the hydraulic pressure pump and by a bypass valve furnished in parallel with the control valve; and a distribution circuit that distributes the hydraulic fluid from the hydraulic pressure pump in the open circuit to the hydraulic pressure actuator in the closed circuit (e.g., see Patent Literature 2).

PRIOR ART LITERATURE

Patent Literature

Patent Literature 1
JP-58-57559-A
Patent Literature 2
JP-2005-76781-A

SUMMARY OF THE INVENTION

Problem to be Solved by the Invention

With the closed hydraulic circuit described in the above-cited Patent Literature 1, excess hydraulic fluid is discharged into the tank by use of the flushing valve that operates on a pilot pressure formed by the head-side circuit pressure on the piston in the cylinder and by the rod-side circuit pressure on the piston. This permits control of the flow rate of the hydraulic fluid flowing through flow lines and provides a stable operating speed of the piston rod.

However, on the work machine, the load exerted on the cylinder (intra-circuit pressure) varies frequently depending on external force and empty weight. Concomitantly, the flow rate of excess hydraulic fluid discharged into the tank varies with the intra-circuit pressure. In this manner, when the load on the cylinder varies, it is difficult to keep constant the flow rate of the hydraulic fluid flowing into the cylinder. This makes it difficult to maintain the piston rod operating speed as desired by the operator, which reduces the operability of the work machine.

The driving device for the work machine described in the above-cited Patent Literature 2 includes an open circuit, a distribution circuit, and a closed circuit furnished with the flushing valve disclosed in Patent Literature 1. The excess hydraulic fluid generated when the piston rod is driven in the contraction direction is discharged into the tank via the flushing valve; the insufficient hydraulic fluid incurred when the piston rod is driven in the extension direction is replenished from the open circuit connected to the head side of the piston in the cylinder. The flow rate of the hydraulic fluid flowing through the flow lines is controlled in this manner, which provides a stable operating speed of the piston rod.

However, when the flow rate of the hydraulic fluid passing through a hydraulic pump inside the closed circuit is the same in both the extension and the contraction directions of the piston rod, the operating speed of the piston rod in the contraction direction becomes lower than that in the extension direction. One problem resulting from this is that the operability of the work machine is reduced.

The present invention has been made in view of the above circumstances, and an object of this invention is to provide a driving device for use with a work machine having a closed hydraulic circuit system for driving cylinders with hydraulic pumps, and permitting substantially the same operating speed of the piston rod in both the extension and the contraction directions regardless of the load exerted on the cylinder, and a work machine furnished with that driving device.

Means for Solving the Problem

In order to solve the above problem, the present invention adopts the structures described in the appended claims for example. This application includes a number of means for solving the above problem, exemplarily including: a first hydraulic pump that has flow rate control device for controlling the flow rate and direction of hydraulic fluid to be delivered; a single rod hydraulic cylinder that is driven with the hydraulic fluid to drive one of work members of a work device on the work machine; a closed hydraulic circuit that connects the first hydraulic pump with the single rod hydraulic cylinder to form a closed circuit using flow lines through which the hydraulic fluid flows; a branch line that branches from the flow line between the first hydraulic pump and the single rod hydraulic cylinder; a first flow line of which one end is connected to the branch line; a tank to which the other end of the first flow line is connected; and a hydraulic fluid flow rate control device that is attached to the first flow line to control the flow rate of the hydraulic fluid flowing from the branch line to the tank or from the tank to the branch line.

Effect of the Invention

The present invention has control device attached to a flow line branched from a closed hydraulic circuit and connected to a tank, the control device controlling the flow rate and direction of hydraulic fluid flowing through the flow line. This allows the operating speed of the piston rod in a cylinder actuated by the closed hydraulic circuit to be substantially the same in both the extension and the contraction directions of the piston rod regardless of the load exerted on the work machine. As a result, excellent operability of the work machine is ensured.

BRIEF DESCRIPTION OF THE DRAWINGS

FIG. 3 is a tabular view listing typical operations of solenoid selector valves and hydraulic pumps in different operation modes of the first embodiment and a second embodiment of the present invention each made up of the driving device for a work machine and the work machine equipped therewith.

MODE FOR CARRYING OUT THE INVENTION

Some embodiments of the present invention each made up of the driving device for a work machine and the work machine equipped therewith are explained below with reference to the accompanying drawings.

First Embodiment

Figure 1:
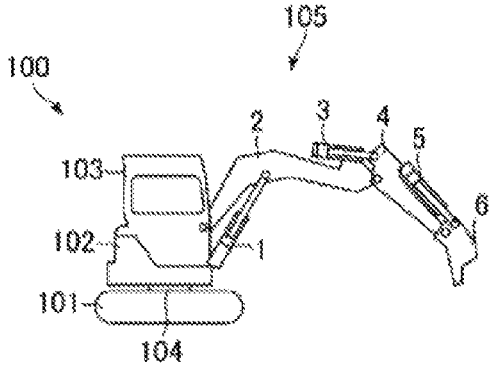
FIG. 1 is a side view of a hydraulic excavator furnished with a first embodiment of the present invention made up of a driving device for a work machine and a work machine equipped therewith.

FIG. 1 is a side view of a hydraulic excavator furnished with the first embodiment of the present invention made up of a driving device for a work machine and a work machine equipped therewith. In FIG. 1, a hydraulic excavator 100 includes a track structure 101, a swing structure 102 mounted swingably on the track structure 101 with a swing device 104 interposed therebetween, a cabin 103 mounted on the swing structure 102, and an articulated front implement 105 attached to the upper front of the cabin 103 and the swing structure 102 in a vertically rotatable manner.

The swing structure 102 is furnished with a driving device including a closed hydraulic circuit and open hydraulic circuits, to be discussed later in detail.

The front implement 105 has a boom 2 with its base end attached pivotably to the swing structure 102, an arm 4 attached pivotably to the tip end of the boom 2, and a bucket 6 attached pivotably to the top end of the arm 4. The boom 2, the arm 4, and the bucket 6 are actuated by a boom cylinder 1, an arm cylinder 3, and a bucket cylinder 5 respectively.

Figure 2:
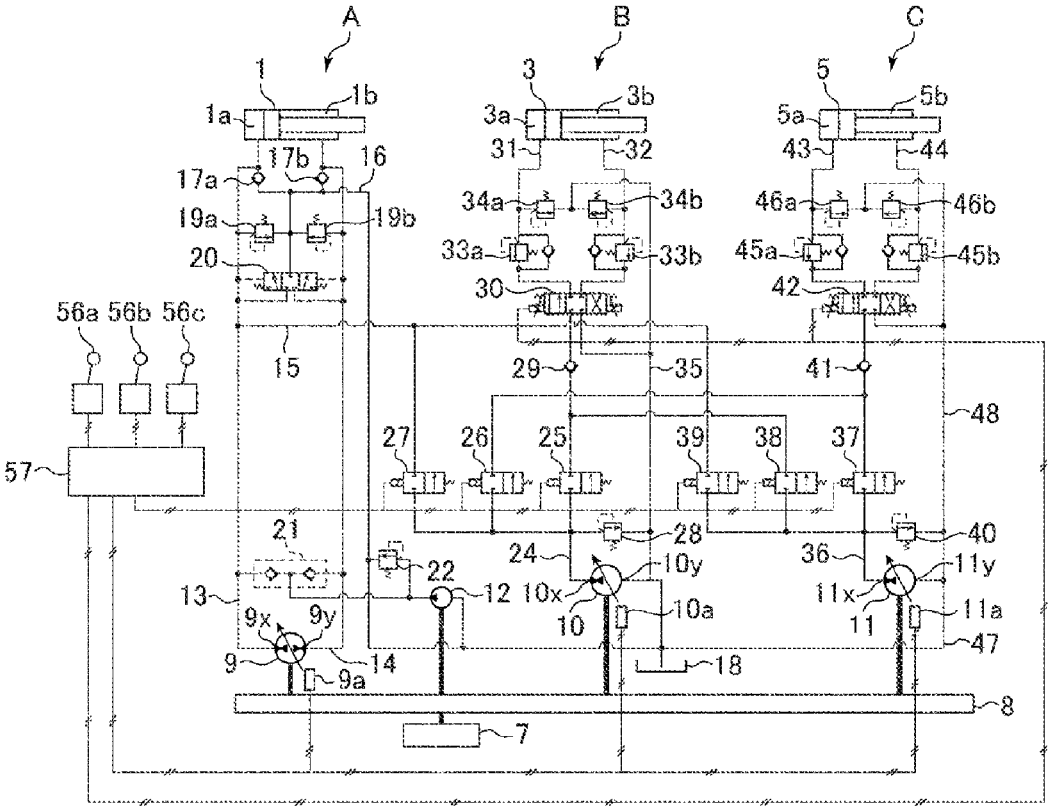
FIG. 2 is a hydraulic circuit diagram of the first embodiment of the present invention made up of the driving device for a work machine and the work machine equipped therewith.

The structure of the driving device of this embodiment is explained next with reference to FIG. 2. FIG. 2 is a hydraulic circuit diagram of the first embodiment of the present invention made up of the driving device for a work machine and the work machine equipped therewith. For this embodiment, the diagram shows only the driving units of the actuators for driving the boom 2, the arm 4, and the bucket 6 making up the hydraulic excavator 100; the other driving units of the traveling actuators for the track structure 101 are omitted. In FIG. 2, the same reference numerals as those in FIG. 2 designate the same components, and their detailed explanations are omitted.

This embodiment is furnished with a closed hydraulic circuit A that couples the boom cylinder 1 for driving the boom 2 with a first hydraulic pump 9, an open hydraulic circuit B that couples the arm cylinder 3 for driving the arm 4 with a second hydraulic pump 10, and an open hydraulic circuit C that couples the bucket cylinder 5 for driving the bucket 6 with a third hydraulic pump 11. The second and the third hydraulic pumps 10 and 11 making up the open hydraulic circuits B and C are equipped with two-way tilting swash plate mechanisms 10*a* and 11*a* for changing the direction of delivery. The open hydraulic circuits B and C are furnished with solenoid selector valves 25 through 27 and 37 through 39 for changing the delivery direction of hydraulic fluid to any one of the closed hydraulic circuit A and open hydraulic circuits B and C. A controller 57 receives the operation amounts of control levers 56*a* through 56*c* for operating the boom 2, the arm 4, and the bucket 6 so as to control the delivery flow rates of the hydraulic pumps 9 through 11, the opening and closing of the solenoid selector valves 25 through 27 and 37 through 39, and the operations of proportional selector valves 30 and 42.

As a result, the excess and shortage of hydraulic fluid incurred when the piston rod of the boom cylinder 1 in the closed hydraulic circuit A is extended and contracted can be compensated by the hydraulic pumps 10 and 11 of the open hydraulic circuits B and C constituting a hydraulic fluid flow rate control device. Consequently, it is possible to prevent fluctuations in the piston rod operating speed and equalize the operating speed when the piston rod of the boom cylinder 1 is extended and contracted, thereby improving the operability of the work machine. The operations implementing this functionality will be discussed later in detail.

In FIG. 2, a power transmission device 8 for distributing the power of an engine 7 is connected to the engine 7 serving as the power source. The power transmission device 8 is furnished with the first hydraulic pump 9 for driving the boom cylinder 1, the second hydraulic pump 10 for driving the arm cylinder 3, the third hydraulic pump 11 for driving the bucket cylinder 5, and a charge pump 12 for replenishing hydraulic fluid to a lower-pressure-side line in the closed hydraulic circuit A, to be discussed later, each pump being attached to the power transmission device 8 with a drive shaft interposed therebetween.

The first hydraulic pump 9, the second hydraulic pump 10, and the third hydraulic pump 11 are furnished respectively with the two-way tilting swash plate mechanisms each having a pair of inlet and outlet ports, and regulators 9*a*, 10*a* and 11*a* each regulating the tilting angle of the two-way tilting swash plate. The regulators 9*a*, 10*a* and 11*a* are controlled by command signals from the controller 57. In this manner, the flow rates of suction and delivery and their directions regarding the first through the third hydraulic pumps 9 through 11 are controlled. Also, the first through the third hydraulic pumps 9 through 11 function as hydraulic motors when supplied with hydraulic fluid.

The closed hydraulic circuit A is now explained. The boom cylinder 1 making up part of the closed hydraulic circuit A is equipped with a cylinder body, a piston installed movably in the cylinder body, and a piston rod attached to one side of the piston. As such, the boom cylinder 1 constitutes a single rod type hydraulic cylinder furnished with a rod-side oil chamber 1*b* and a head-side oil chamber 1*a*.

A boom control lever 56*a* is installed in the cabin 103. An operation amount signal from the boom control lever 56*a* is input to the controller 57. In turn, the controller 57 controls the hydraulic pumps 9, 10 and 11 and the selector valves 25 through 27 and 37 through 39 in a manner attaining the piston rod operating speed corresponding to the operation amount signal.

The first hydraulic pump 9 has two hydraulic fluid delivery/suction ports 9*x* and 9*y*. One hydraulic fluid delivery/suction port 9*x* is coupled with one end of a first line 13. The other end of the first line 13 is coupled to the connection port of the head-side oil chamber 1*a* of the boom cylinder 1. The other hydraulic fluid delivery/suction port 9*y* is coupled with one end of a second line 14. The other end of the second line 14 is coupled to the connection port of the rod-side oil chamber 1*b* of the boom cylinder 1.

The first line 13 is coupled with the outlet side of a check valve 17*a* permitting suction only, the inlet side of a relief valve 19*a*, one inlet port of a flushing valve 20, and one outlet side of a charge check valve 21 permitting suction only. The inlet side of the check valve 17*a* and the outlet side of the relief valve 19*a* are coupled to the outlet port of the flushing valve 20 and are communicated with a tank 18 via a line 16. Also, the first line 13 is coupled with one end of a communicating line 15 that permits connection with the second hydraulic pump 10 and the third hydraulic pump 11 via solenoid selector valves, to be discussed later.

The second line 14 is coupled with the outlet side of a check valve 17*b* permitting suction only, the inlet side of a relief valve 19*b*, the other inlet port of the flushing valve 20, and the other outlet side of the charge check valve 21 permitting suction only. The inlet side of the check valve 17*b* and the outlet side of the relief valve 19*b* are coupled to the outlet port of the flushing valve 20 and are communicated with the tank 18 via the line 16.

The inlet side of the charge check valve 21 is coupled to the delivery line of the charge pump 12. The hydraulic fluid delivered by the charge pump 12 is supplied by the charge check valve 21 to the first line 13 or the second line 14, whichever has the lower pressure. Also, a charge relief valve 22 for limiting the delivery pressure of the charge pump 12 is attached to the delivery line of the charge pump 12, with the outlet side of the charge relief valve 22 communicated with the tank 18. Further, the suction port of the charge pump 12 is communicated with the tank 18 via a suction line.

The check valves 17*a* and 17*b* attached to the first and the second lines 13 and 14 are designed to supply hydraulic fluid from the tank 18 via the line 16 when the pressure in any one of the lines becomes negative or when the flow rate of hydraulic fluid in the rod-side oil chamber 1*b* or head-side oil chamber 1*a* becomes insufficient upon actuation of the boom cylinder 1. This prevents the occurrence of cavitation.

The relief valves 19*a* and 19*b* attached to the first and the second lines 13 and 14 are designed to discharge hydraulic fluid into the tank 18 via the line 16 when the pressure in any one of the lines has exceeded a predetermined pressure level. This prevents the breakage of pumps or lines.

The flushing valve 20 is switched when the difference in pressure between the first line 13 and the second line 14 has exceeded a predetermined pressure level. Thus switched, the flushing valve 20 connects the line having the lower pressure with the line 16, thereby discharging the excess hydraulic fluid of the lower-pressure-side line into the tank 18.

The open hydraulic circuit B is explained next. As with the boom cylinder 1, the arm cylinder 3 is a single rod type hydraulic pressure cylinder equipped with a rod-side oil chamber 3*b* and a head-side oil chamber 3*a*.

An arm control lever 56*b* is installed in the cabin 103. An operation amount signal from the arm control lever 56*b* is input to the controller 57. In turn, the controller 57 controls the hydraulic pumps 9, 10 and 11, the solenoid selector valves 25, 26 and 27, and an arm cylinder proportional selector valve 30 in a manner attaining the piston rod operating speed corresponding to the operation amount signal.

The second hydraulic pump 10 acting as a hydraulic fluid flow rate control device has two suction/delivery ports 10*x* and 10*y*. One suction/delivery port 10*y* is coupled with one end of a line 23. The other end of the line 23 is coupled to the tank 18. The other suction/delivery port 10*x* is coupled with one end of a line 24. The other end of the line 24 branches in three ways, the branches being coupled with the inlet ports of the first through the third solenoid selector valves 25 through 27 respectively. Also, a relief valve 28 for limiting the delivery pressure of the second hydraulic pump 10 is attached to the line 24, with the outlet side of the relief valve 28 communicated with the tank 18 via the line 23.

The first through the third solenoid selector valves 25 through 27 are each a two-port two-position type solenoid selector valve of which one end is equipped with a solenoid operation part for receiving a command signal from the controller 57, the other end of the valve being furnished with a spring part. The presence or absence of the command signal coming from the controller 57 triggers switching of the destination to which to supply the hydraulic fluid fed from the second hydraulic pump 10. The outlet port of the first solenoid selector valve 25 is coupled via a line to the inlet side of the check valve 29 permitting delivery only. The outlet side of the check valve 29 is connected to the pump port of the arm cylinder proportional selector valve 30 for controlling the flow rate and direction of the hydraulic fluid supplied to the arm cylinder 3.

Also, the outlet port of the second solenoid selector valve 26 is coupled via a check valve 41 to the pump port of a bucket cylinder proportional solenoid valve 42, to be discussed later. Furthermore, the outlet port of the third solenoid selector valve 27 is coupled via the communicating line 15 to the first line 13 of the closed hydraulic circuit A.

The arm cylinder proportional selector valve 30 is a four-port three-position type solenoid proportional selector valve of which one end is equipped with a solenoid operation part for receiving a command signal from the controller 57, the other end of the valve being furnished with a spring part. A tank port of the arm cylinder proportional selector valve 30 is coupled to the tank 18 via a line 35 communicated with the line 23. One end of the outlet port of the arm cylinder proportional selector valve 30 is coupled with one end of the first line 31. The other end of the first line 31 is coupled to the connection port of the head-side oil chamber 3*a* of the arm cylinder 3. The other end of the outlet port of the arm cylinder proportional selector valve 30 is coupled with one end of the second line 32. The other end of the second line 32 is coupled to the connection port of the rod-side oil chamber 3*b* of the arm cylinder 3.

In accordance with the command signal from the controller 57, the arm cylinder proportional selector valve 30 switches the flowing direction of the hydraulic fluid from the check valve 29 to either the first line 31 or to the second line 32 and controls the valve opening, thereby controlling the flow rate of the hydraulic fluid supplied to the arm cylinder 3.

In the first line 31, a counterbalance valve 33*a* is installed serially so that its inlet side is oriented toward the arm cylinder 3 and its outlet side toward the arm cylinder proportional selector valve 30. The first line 31 is also coupled with the inlet side of a relief valve 34*a*. The outlet side of the relief valve 34*a* is communicated with the tank 18 via a line 35 communicated with the line 23.

In the second line 32, a counterbalance valve 33*b* is installed serially so that its inlet side is oriented toward the arm cylinder 3 and its outlet side toward the arm cylinder proportional selector valve 30. The second line 32 is also coupled with the inlet side of a relief valve 34*b*. The outlet side of the relief valve 34*a* is communicated with the tank 18 via the line 35 communicated with the line 23.

The counterbalance valves 33*a* and 33*b* installed in the first and the second lines 31 and 32 are designed to prevent the arm cylinder 3 from falling under its empty weight. Likewise, the relief valves 34*a* and 34*b* are designed to discharge the hydraulic fluid into the tank 18 via the line 35 when the pressure in any one of the lines has exceeded a predetermined pressure level, thereby preventing breakage of pumps or lines.

The open hydraulic circuit C is explained next. As with the boom cylinder 1, the bucket cylinder 5 is a single rod type hydraulic cylinder equipped with a rod-side oil chamber 5*b* and a head-side oil chamber 5*a*.

A bucket control lever 56*c* is installed in the cabin 103. An operation amount signal from the bucket control lever 56*c* is input to the controller 57. In turn, the controller 57 controls the hydraulic pumps 9, 10 and 11, the solenoid selector valves 37, 38 and 39, and the bucket cylinder proportional solenoid valve 42 in a manner attaining the piston rod operating speed corresponding to the operation amount signal.

The third hydraulic pump 11 acting as a hydraulic fluid flow rate control device has two suction/delivery ports 11*x* and 11*y*. One suction/delivery port 11*y* is coupled with one end of a line 47. The other end of the line 47 is coupled to the tank 18. The other suction/delivery port 11*x* is coupled with one end of a line 36. The other end of the line 36 branches in three ways, the branches being coupled with the inlet ports of the first through the third solenoid selector valves 37 through 39 respectively. Also, a relief valve 40 for limiting the delivery pressure of the third hydraulic pump 11 is attached to the line 36, with the outlet side of the relief valve 40 communicated with the tank 18 via the line 47.

The first through the third solenoid selector valves 37 through 39 are each a two-port two-position type solenoid selector valve of which one end is equipped with a solenoid operation part for receiving a command signal from the controller 57, the other end of the valve being furnished with a spring part. The presence or absence of the command signal coming from the controller 57 triggers switching of the destination to which to supply the hydraulic fluid coming from the third hydraulic pump 11. The outlet port of the first solenoid selector valve 37 is coupled via a line to the inlet side of the check valve 41 permitting delivery only. The outlet side of the check valve 41 is connected to the pump port of the bucket cylinder proportional selector valve 42 for controlling the flow rate and direction of the hydraulic fluid supplied to the bucket cylinder 5.

Also, the outlet port of the second solenoid selector valve 38 is coupled via the check valve 29 to the pump port of the arm cylinder proportional solenoid valve 30 of the open hydraulic circuit B. Furthermore, the outlet port of the third solenoid selector valve 39 is coupled via the communicating line 15 to the first line 13 of the closed hydraulic circuit A.

The bucket cylinder proportional selector valve 42 is a four-port three-position type solenoid proportional selector valve of which one end is equipped with a solenoid operation part for receiving a command signal from the controller 57, the other end of the valve being furnished with a spring part. The tank port of the bucket cylinder proportional selector valve 42 is coupled to the tank 18 via a line 48 communicated with the line 47. One end of the outlet port of the bucket cylinder proportional selector valve 42 is coupled with one end of the first line 43. The other end of the first line 43 is coupled to the connection port of the head-side oil chamber 5*a* of the bucket cylinder 5. The other end of the outlet port of the bucket cylinder proportional selector valve 42 is coupled with one end of the second line 44. The other end of the second line 44 is coupled to the connection port of the rod-side oil chamber 5*b* of the bucket cylinder 5.

In accordance with the command signal from the controller 57, the bucket cylinder proportional selector valve 42 switches the flowing direction of the hydraulic fluid from the check valve 41 to either the first line 43 or to the second line 44 and controls the valve opening, thereby controlling the flow rate of the hydraulic fluid supplied to the bucket cylinder 5.

In the first line 43, a counterbalance valve 45*a* is installed serially so that its inlet side is oriented toward the bucket cylinder 5 and its outlet side toward the bucket cylinder proportional selector valve 42. The first line 43 is also coupled with the inlet side of a relief valve 46*a*. The outlet side of the relief valve 46*a* is communicated with the tank 18 via the line 48 communicated with the line 47.

In the second line 44, a counterbalance valve 45*b* is installed serially so that its inlet side is oriented toward the bucket cylinder 5 and its outlet side toward the bucket cylinder proportional selector valve 42. The second line 44 is also coupled with the inlet side of a relieve valve 46*b*. The outlet side of the relief valve 46*a* is communicated with the tank 18 via the line 48 communicated with the line 47.

The counterbalance valves 45*a* and 45*b* installed in the first and the second lines 43 and 44 are designed to prevent the bucket cylinder 5 from falling under its empty weight. Likewise, the relief valves 46*a* and 46*b* are designed to discharge the hydraulic fluid into the tank 18 via the line 48 when the pressure in any one of the lines has exceeded a predetermined pressure level, thereby preventing breakage of pumps or lines.

Figure 4:
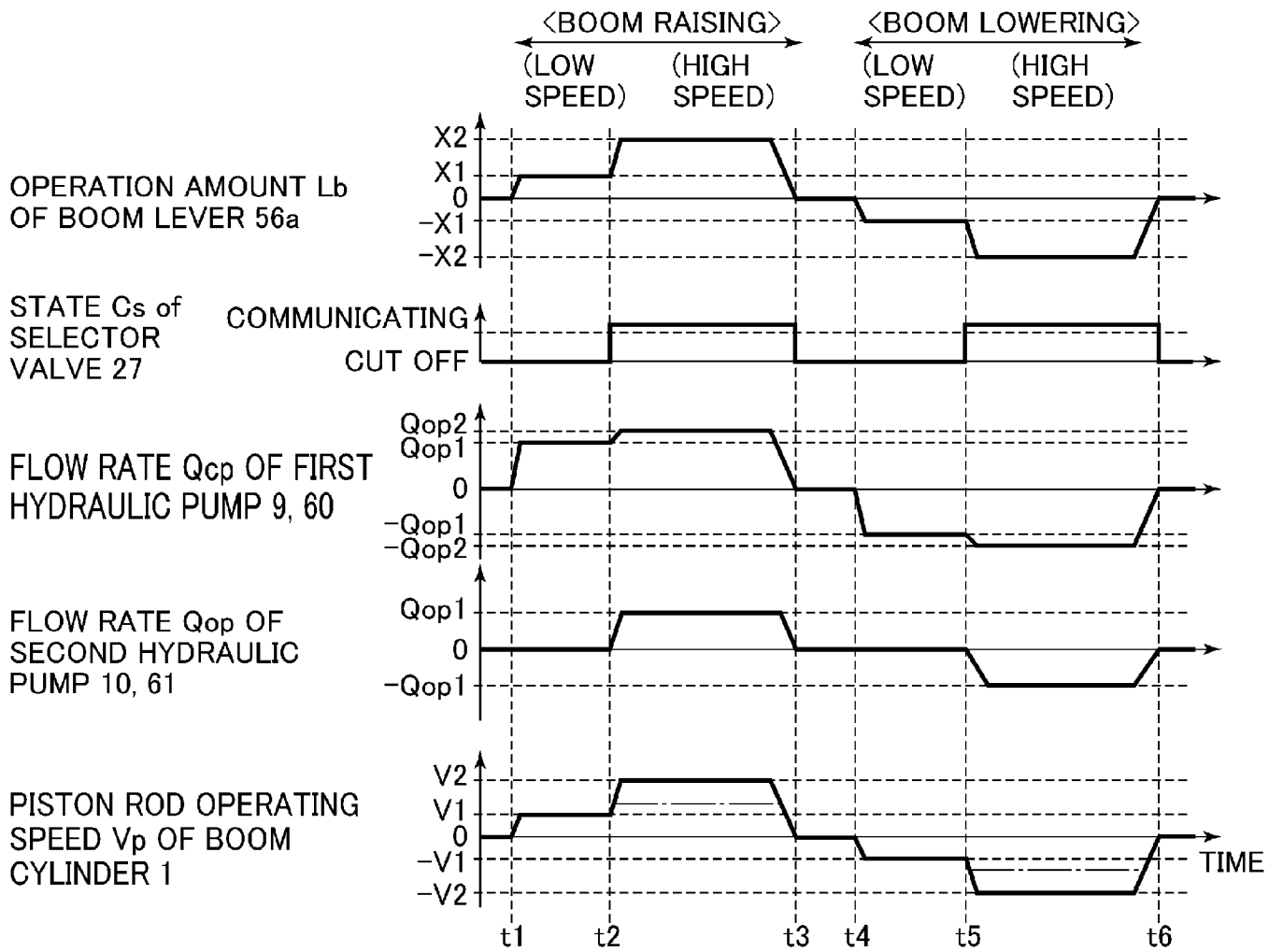
FIG. 4 is a set of characteristic diagrams showing typical relations among the state of a selector valve, the flow rate of a first hydraulic pump, the flow rate of a second hydraulic pump, and the speed of a boom in the first and the second embodiments of the present invention each made up of the driving device for a work machine and the work machine equipped therewith.

Explained next with reference to FIGS. 3 and 4 are the operations of the first embodiment of the present invention made up of the driving device for a work machine and the work machine equipped therewith. FIG. 3 is a tabular view listing typical operations of solenoid selector valves and hydraulic pumps in different operation modes of the first and the second embodiment of the present invention each made up of the driving device for a work machine and the work machine equipped therewith. FIG. 4 is a set of characteristic diagrams showing typical relations among the state of a selector valve, the flow rate of a first hydraulic pump, the flow rate of a second hydraulic pump, and the speed of a boom in the first and the second embodiments of the present invention each made up of the driving device for a work machine and the work machine equipped therewith. In FIGS. 3 and 4, the same reference symbols as those in FIGS. 1 and 2 designate the same components, and their detailed explanations are omitted.

FIG. 3 lists typical operations of the solenoid valves, proportional selector valves, and hydraulic pumps in different operation modes under control of the controller 57 in this embodiment. First, the non-operating state (stopped state) indicated in FIG. 3 refers to a state in which none of the boom control lever 56*a*, the arm control lever 56*b*, and the bucket control lever 56*c* is operated and in which none of the signals from these control levers is input to the controller 57. In this case, the controller 57 outputs a minimum tilting angle control command signal to the regulators 9*a*, 10*a* and 11*a* of the first through the third hydraulic pumps 9, 10 and 11 shown in FIG. 2. At the same time, the controller 57 outputs a cut-off close command signal to the first through the third solenoid selector valves 25 through 27 of the open hydraulic circuit B and to the first through the third solenoid selector valves 37 through 39 of the open hydraulic circuit C. Also, the controller 57 outputs a cut-off command signal to the arm cylinder proportional selector valve 30 and bucket cylinder proportional selector valve 42. As a result, the boom cylinder 1, the arm cylinder 3, and the bucket cylinder 5 are held in the non-operating state. Also in FIG. 3, a pump "OFF" refers to a minimum tilting angle state, and a pump "ON" refers to a state larger than the minimum tilting angle state.

The individual operation of the boom 2 is explained next. In FIG. 4, the horizontal axis denotes time. On the vertical axis from the top down, reference character (a) stands for the operation amount Lb of the boom lever, (b) for the state Cs of the selector valve 27, (c) for the flow rate Qcp of the first hydraulic pump, (d) for the flow rate Qop of the second hydraulic pump, and (e) for the piston rod speed Vb of the boom cylinder 1. The period from time t1 to time t3 indicates the characteristics in effect when the piston rod of the boom cylinder 1 is extended (to raise the boom); the period from time t4 to time t6 depicts the characteristics in effect when the piston rod of the boom cylinder 1 is contracted (to lower the boom).

The raising operation of the boom 2 is explained first. Returning to FIG. 2, when the operator starts operating the boom control lever 56*a* in the direction of piston rod extension, the controller 57 outputs a command signal to the regulator 9*a* of the first hydraulic pump 9 causing the tilting angle of the swash plate to be raised. Here, if the operation amount of the boom control lever 56*a* is as small as X1 as indicated at time t1 in FIG. 4, the delivery flow rate of the first hydraulic pump 9 reaches Qcp1 so that the piston rod of the boom cylinder 1 is extended at speed V1 (low speed).

At this point, in FIG. 2, the hydraulic fluid from the first hydraulic pump 9 is supplied to the head-side oil chamber 1*a* of the boom cylinder 1 via one hydraulic fluid delivery/suction port 9*x* of the first hydraulic pump 9 and the first line 13. On the other hand, the hydraulic fluid in the rod-side oil chamber 1*b* of the boom cylinder 1 is returned to the other hydraulic fluid delivery/suction port 9*y* of the first hydraulic pump 9 via the second line 14. At this point, the flow rate of the hydraulic fluid returning from the rod-side oil chamber 1*b* of the boom cylinder 1 to the first hydraulic pump 9 is lower than the flow rate of the hydraulic fluid supplied from the first hydraulic pump 9 to the head-side oil chamber 1*a* of the boom cylinder 1. The insufficient flow rate of the hydraulic fluid is compensated by the charge pump 12 supplying the hydraulic fluid to the other hydraulic fluid delivery/suction port 9*y* of the first hydraulic pump 9 via the charge check valve 21 and the second line 14.

When the operator increases the operation amount of the boom control lever 56*a* to further increase the speed at which to extend the piston rod of the boom cylinder 1, the controller 57 outputs a command signal to the regulator 10*a* of the second hydraulic pump 10 causing the tilting angle of the swash plate to be raised. At the same time, the controller 57 outputs a communication command signal to the third solenoid selector valve 27 of the open hydraulic circuit B. This causes the head-side oil chamber 1*a* of the boom cylinder 1 to be replenished with the hydraulic fluid coming from the second hydraulic pump 10 via third solenoid selector valve 27. Here, if the operation amount of the boom control lever 56*a* has exceeded X1 to reach X2 as indicated at time t2 in FIG. 4, the third solenoid selector valve 27 is placed in the communicating state, and the delivery flow rates of the second and the first hydraulic pumps 10 and 9 reach Qop1 and Qcp2 respectively. As a result, the hydraulic fluid flows into the head-side oil chamber 1*a* of the boom cylinder 1 at a flow rate of Qop1+Qcp2 so that the piston rod is extended at speed V2 (high speed).

When the above-described lever manipulation is performed to increase the speed at which to extend the piston rod of the boom cylinder 1, the controller 57 may output a command signal to the third hydraulic pump 11 and to the third solenoid selector valve 39 of the open hydraulic circuit C, instead of issuing the command signal to the second hydraulic pump 10 and to the third solenoid selector valve 27 of the open hydraulic circuit B, thereby attaining the high-speed operation.

The lowering operation of the boom 2 is explained next. Returning to FIG. 2, when the operator starts operating the boom control lever 56*a* in the direction of piston rod contraction, the controller 57 outputs a command signal to the regulator 9*a* of the first hydraulic pump 9 causing the tilting angle of the swash plate to be lowered. Here, if the operation amount of the boom control lever 56*a* is as small as −X1 as indicated at time t4 in FIG. 4, the delivery flow rate of the first hydraulic pump 9 reaches −Qcp1 causing the piston rod of the boom cylinder 1 to contract at speed −V1 (low speed).

At this point, in FIG. 2, the hydraulic fluid from the first hydraulic pump 9 is supplied to the rod-side oil chamber 1*b* of the boom cylinder 1 via the other hydraulic fluid delivery/suction port 9*y* of the first hydraulic pump 9 and the second line 14. On the other hand, the hydraulic fluid in the head-side oil chamber 1*a* of the boom cylinder 1 is returned to one hydraulic fluid delivery/suction port 9*x* of the first hydraulic pump 9 via the first line 13. At this point, the flow rate of the hydraulic fluid returning from the head-side oil chamber 1*a* of the boom cylinder 1 to the first hydraulic pump 9 is higher than the flow rate of the hydraulic fluid supplied from the first hydraulic pump 9 to the rod-side oil chamber 1*b* of the boom cylinder 1. The excess hydraulic fluid is returned from the first line 13 to the tank 18 via the flushing valve 20 and the line 16.

At this point, the pressure of the hydraulic fluid returning from the head-side oil chamber 1*a* of the boom cylinder 1 to the first hydraulic pump 9 is boosted under the empty weight of the front implement 105. When supplied with the pressurized hydraulic fluid, the first hydraulic pump 9 is driven as a hydraulic motor. The power of the first hydraulic pump 9 generated by the pressurized hydraulic fluid is transmitted to and absorbed by the engine 7 and other hydraulic pumps via the power transmission device 8. Although not shown, the power transmission device 8 may be coupled with a motor generator and an electrical storage device to store the power that has overflowed and cannot be absorbed so that the power can be recycled.

When the operator raises the operation amount of the boom control lever 56*a* to further increase the speed at which to contract the piston rod of the boom cylinder 1, the controller 57 outputs a command signal to the regulator 10*a* of the second hydraulic pump 10 causing the tilting angle of the swash plate to be lowered. At the same time, the controller 57 outputs a communication command signal to the third solenoid selector valve 27 of the open hydraulic circuit B. This causes the second hydraulic pump 10 to act in a manner sucking the hydraulic fluid from the other suction/delivery port 10*x*. As a result, the discharge of the hydraulic fluid from the head-side oil chamber 1*a* of the boom cylinder 1 into the tank 18 is promoted through the communicating line 15 and the third solenoid selector valve 27.

If the operation amount of the boom control lever 56*a* has exceeded −X1 to reach −X2 as indicated at time t5 in FIG. 4, the third solenoid selector valve 27 is placed in the communicating state. At the same time, the delivery flow rates of the second and the first hydraulic pumps 10 and 9 become −Qop1 and −Qcp2 respectively. As a result, the hydraulic fluid flows from the head-side oil chamber 1*a* of the boom cylinder 1 at a flow rate of −(Qop1+Qcp2), so that the piston rod is contracted at speed −V2 (high speed). At this point, the hydraulic fluid returning from the head-side oil chamber 1*a* of the boom cylinder 1 to the second hydraulic pump 10 is highly pressurized. When supplied with the pressurized hydraulic fluid, the second hydraulic pump 10 is driven as a hydraulic motor. The power of the second hydraulic pump 10 generated by the pressurized hydraulic fluid is transmitted to and absorbed by the engine 7 and other hydraulic pumps via the power transmission device 8.

When the above-described lever manipulation is performed to increase the speed at which to contract the piston rod of the boom cylinder 1, the controller 57 may output an operation command signal to the third hydraulic pump 11 and to the third solenoid selector valve 39 of the open hydraulic circuit C, instead of issuing the operation command signal to the second hydraulic pump 10 and to the third solenoid selector valve 27 of the open hydraulic circuit B, thereby attaining the high-speed operation.

In this embodiment, when the lever manipulation is performed to increase the speed at which to contract the piston rod of the boom cylinder 1, the second hydraulic pump 10 and the first hydraulic pump 9 are used together to admit the hydraulic fluid flowing from the head-side oil chamber 1*a* of the boom cylinder 1. In this manner, the operating speed of the piston rod of the boom cylinder 1 is boosted.

The individual operation of the arm 4 is explained next. In FIG. 2, when the operator starts operating the arm control lever 56*b* in the direction of piston rod extension, the controller 57 outputs a command signal to the regulator 10*a* of the second hydraulic pump 10 causing the tilting angle of the swash plate to be raised. At the same time, the controller 57 outputs a communication command signal to the first solenoid selector valve 25 of the open hydraulic circuit B and a forward opening command signal to the arm cylinder proportional selector valve 30. This causes the tilting angle of the swash plate to be raised in the second hydraulic pump 10 and opens the arm cylinder proportional selector valve 30 in the direction coupling the check valve 29 with the first line 31.

As a result, the hydraulic fluid from the second hydraulic pump 10 is supplied to the head-side oil chamber 3*a* of the arm cylinder 3 via the other suction/delivery port 10*x* of the pump 10, the line 24, and the first line 31. Meanwhile, the hydraulic fluid in the rod-side oil chamber 3*b* of the arm cylinder 3 is returned to the tank 18 via the second line 32, the arm cylinder proportional selector valve 30, and the line 35. Consequently, the piston rod of the arm cylinder 3 is extended.

An arm damping operation is explained next. When the operator starts operating the arm control lever 56*b* in the direction of piston rod contraction, the controller 57 outputs a command signal to the regulator 10*a* of the second hydraulic pump 10 causing the tilting angle of the swash plate to be raised. At the same time, the controller 57 outputs a communication command signal to the first solenoid selector valve 25 of the open hydraulic circuit B and a reverse opening command signal to the arm cylinder proportional selector valve 30. This causes the tilting angle of the swash plate to be raised in the second hydraulic pump 10 and opens the arm cylinder proportional selector valve 30 in the direction coupling the check valve 29 with the second line 32.

The hydraulic fluid from the second hydraulic pump 10 is supplied to the rod-side oil chamber 3*b* of the arm cylinder 3 via the other suction/delivery port 10*x* of the pump 10, the line 24, and the second line 32. Meanwhile, the hydraulic fluid in the head-side oil chamber 3*a* of the arm cylinder 3 is returned to the tank 18 via the first line 31, the arm cylinder proportional selector valve 30, and the line 35. Consequently, the piston rod of the arm cylinder 3 is contracted.

The individual operation of the bucket 6 is performed in the same manner as that of the arm 4 and thus will not be discussed further.

A combined operation of the actuators is explained next with reference to FIGS. 2 and 3. As shown in FIG. 3, it is assumed that the boom 2, the arm 4, and the bucket 6 are operated in a combined manner. In that case, if the boom 2 is to be operated at low speed, the boom cylinder 1, arm cylinder 3, and the bucket cylinder 5 are supplied with the hydraulic fluid respectively from the first hydraulic pump 9, the second hydraulic pump 10, and the third hydraulic pump 11 driving the respective piston rods. Specifically, the controller 57 outputs a communication command signal to the first solenoid selector valve 25 of the open hydraulic circuit B, an opening command signal to the arm cylinder proportional selector valve 30, a communication command signal to the first solenoid selector valve 37 of the open hydraulic circuit C, and an opening command signal to the bucket cylinder proportional selector valve 42.

On the other hand, if the boom 2 is to be operated at high speed, e.g., if the piston rod of the boom cylinder 1 is to be extended at a speed exceeding a predetermined threshold value, the controller 57 outputs a command signal to the regulator 10*a* of the second hydraulic pump 10 causing the tilting angle of the swash plate to reflect the operation amount of the boom control lever 56*a*. At the same time, the controller 57 outputs a cut-off command signal to the first solenoid selector valve 25 of the open hydraulic circuit B and a communication command signal to the third solenoid selector valve 27.

As a result, the head-side oil chamber 1*a* of the boom cylinder 1 is replenished with the hydraulic fluid from the second hydraulic pump 10, so that the piston rod of the boom cylinder 1 is extended at a speed corresponding to the operation amount of the boom control lever 56*a*.

Meanwhile, the controller 57 outputs a command signal to the regulator 11*a* of the third hydraulic pump 11 causing the tilting angle of the swash plate to reflect the operation amount of the arm control lever 56*b*, and also outputs a communication command signal to the second solenoid selector valve 38 of the open hydraulic circuit C. This causes the arm cylinder 3 to be supplied with the hydraulic fluid from the third hydraulic pump 11 via the arm cylinder proportional selector valve 30, whereby the piston rod of the arm cylinder 3 is drive-controlled.

When the above operation is carried out, the controller 57 may control the swash plate of the third hydraulic pump 11 instead of the second hydraulic pump 10 and may output a cut-off command signal to the first solenoid selector valve 37 of the open hydraulic circuit C and a communication command signal to the third solenoid selector valve 39 instead of the cut-off command signal to the first solenoid selector valve 25 of the open hydraulic circuit B and the communication command signal to the third solenoid selector valve 27, thereby replenishing the head-side oil chamber 1*a* of the boom cylinder 1 with the hydraulic fluid from the third hydraulic pump 11.

Where the boom 2, the arm 4, and the bucket 6 are operated in combined fashion and where the piston rod of the boom cylinder 1 is contracted at low speed, the first hydraulic motor 9 is driven as a hydraulic motor as described above. For this reason, the power of the first hydraulic pump 9 generated by the pressurized hydraulic fluid is transmitted to and absorbed by the engine 7 and other hydraulic pumps via the power transmission device 8.

Meanwhile, if the piston rod of the boom cylinder 1 is to be contracted at a speed exceeding a predetermined threshold value, the controller 57 outputs a command signal to the regulator 10*a* of the second hydraulic pump 10 reflecting the operation amount of the boom control lever 56*a* in the opposite direction of the above-mentioned high-speed extension. At the same time, the controller 57 outputs a cut-off command signal to the first solenoid selector valve 25 of the open hydraulic circuit B and a communication command signal to the third solenoid selector valve 27.

As a result, the second hydraulic pump 10 acts to suck the hydraulic fluid from the head-side oil chamber 1*a* of the boom cylinder 1, so that the piston rod of the boom cylinder 1 is controlled to be contracted at a speed corresponding to the operation amount of the boom control lever 56*a*. At this point, the hydraulic fluid returning to the second hydraulic pump 10 is highly pressurized. When supplied with the pressurized hydraulic fluid, the second hydraulic pump 10 is driven as a hydraulic motor. The power of the second hydraulic pump 10 generated by the pressurized hydraulic fluid is transmitted to and absorbed by the engine 7 and other hydraulic pumps via the power transmission device 8.

Meanwhile, the controller 57 outputs a command signal to the regulator 11*a* of the third hydraulic pump 11 causing the tilting angle of the swash plate to reflect the operation amount of the arm control lever 56*b*, and also outputs a communication command signal to the second solenoid selector valve 38 of the open hydraulic circuit C. This causes the arm cylinder 3 to be supplied with the hydraulic fluid from the third hydraulic pump 11 via the arm cylinder proportional selector valve 30, whereby the piston rod of the arm cylinder 3 is drive-controlled.

When the above operation is carried out, the controller 57 may control the swash plate of the third hydraulic pump 11 instead of the second hydraulic pump 10 and may output a cut-off command signal to the first solenoid selector valve 37 of the open hydraulic circuit C and a communication command signal to the third solenoid selector valve 39 instead of the cut-off command signal to the first solenoid selector valve 25 of the open hydraulic circuit B and the communication command signal to the third solenoid selector valve 27, thereby supplying the third hydraulic pump 11 with the hydraulic fluid from the head-side oil chamber 1*a* of the boom cylinder 1.

According to the first embodiment of the present invention made up of the driving device for a work machine and the work machine equipped therewith, the second hydraulic pump 10 and the third hydraulic pump 11 are attached to the communicating line 15 branched from the closed hydraulic circuit and connected to the tank 18, the pumps 10 and 11 serving as the device for controlling the flow rate and direction of the hydraulic fluid (i.e., operating oil) flowing through the communicating line 15. With this structure, the operating speed of the piston rod of the boom cylinder 1 actuated by the closed hydraulic circuit is made substantially the same in both the extension and the contracting directions regardless of the load exerted on the work machine. As a result, excellent operability of the work machine is ensured.

Also according to the first embodiment of the present invention made up of the driving device for a work machine and the work machine equipped therewith, a two-way tilting swash plate mechanism pump is used as the second hydraulic pump 10 capable of controlling the direction of delivery. Thus the second hydraulic pump 10 makes the flow rate of the hydraulic fluid replenishing the head-side oil chamber 1*a* of the boom cylinder 1 when the piston rod of the boom cylinder 1 is extended at high speed, substantially the same as the flow rate of the hydraulic fluid flowing from the head-side oil chamber 1*a* of the boom cylinder 1 when the piston rod of the boom cylinder 1 is contracted at high speed. As a result, the operating speed of the piston rod of the boom cylinder 1 is made substantially the same in both the extension and the contracting directions, so that excellent operability of the work machine is provided.

Further, according to the first embodiment of the present invention made up of the driving device for a work machine and the work machine equipped therewith, when the piston rod of the boom cylinder 1 is operated at low speed, the charge pump 12 and the flushing valve 20 combine to compensate the excess or shortage of the hydraulic fluid in the flow rate balance caused by the difference in volume between the head-side oil chamber 1*a* and the rod-side oil chamber 1*b* of the boom cylinder 1; when the piston rod of the boom cylinder 1 is operated at high speed, the second hydraulic pump 10 compensates the above-mentioned excess or shortage of the hydraulic fluid in the flow rate balance of the boom cylinder 1. In this manner, in keeping with the operating speed of the piston rod of the boom cylinder 1, the use or nonuse of the second hydraulic pump 10 is selected in the closed hydraulic circuit A, which makes it possible to downsize the charge bump 12. Also, when there occur fluctuations of the pressure inside the lines during high-speed operation, the second hydraulic pump 10 provides flow rate control, thereby ensuring a stable operation state.

Also according to the first embodiment of the present invention made up of the driving device for a work machine and the work machine equipped therewith, the hydraulic fluid flowing from the head-side oil chamber 1*a* of the boom cylinder 1 when the piston rod of the boom cylinder 1 is contracted at high speed is guided to the first hydraulic pump 9 and the second hydraulic pump 10. This allows the displacement of the first hydraulic pump 9 to be smaller than that of its counterpart in the past.

Furthermore, according to the first embodiment of the present invention made up of the driving device for a work machine and the work machine equipped therewith, the second hydraulic pump 10 and the third hydraulic pump 11 are provided as the hydraulic pumps of the open hydraulic circuits. With this structure, if the second hydraulic pump 10 is used to drive the piston rod of the boom cylinder 1 for example, the third hydraulic pump 11 may be used to drive the piston rod of the arm cylinder 3 as well as the piston rod of the bucket cylinder 5.

Second Embodiment

Figure 5:
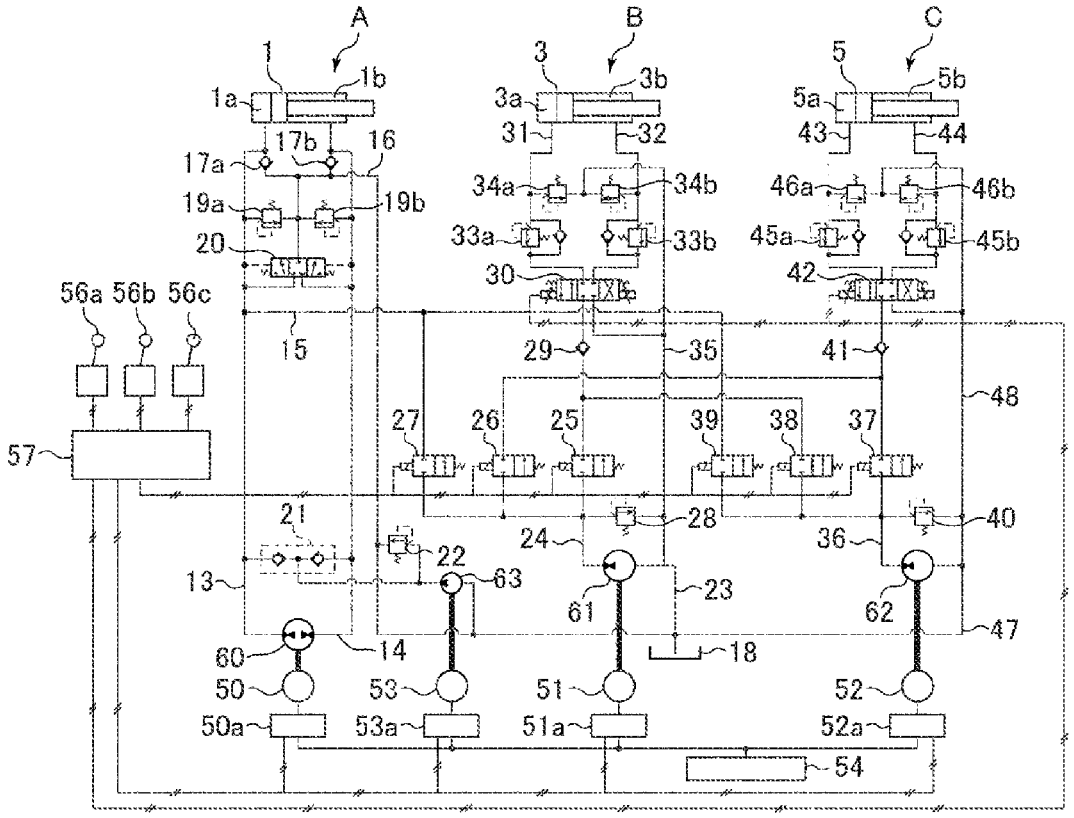
FIG. 5 is a hydraulic circuit diagram of the second embodiment of the present invention made up of the driving device for a work machine and the work machine equipped therewith.

Explained below with reference to the relevant accompanying drawings is the second embodiment of the present invention made up of the driving device for a work machine and the work machine equipped therewith. FIG. 5 is a hydraulic circuit diagram of the second embodiment of the present invention made up of the driving device for a work machine and the work machine equipped therewith. In FIG. 5, the same reference numerals as those used in FIGS. 1 through 4 designate the same components, and their detailed explanations are omitted.

The second embodiment of the present invention made up of the driving device for a work machine and the work machine equipped therewith as shown in FIG. 5 is configured with approximately the same components as those of the first embodiment except for the following structures: In the first embodiment, the first through the third hydraulic pumps 9 through 11 and the charge pump 12 are driven by the power transmission device 8 distributing the power of the engine 7 by way of the drive shafts of these pumps. In the second embodiment, by contrast, a first through a third hydraulic pumps 60 through 62 and a charge pump 61 are driven by a first through a third motor generators 50 through 52 and a charge motor generator 53 that are coupled with these pumps by way of their drive shafts. And in the first embodiment, the first through the third hydraulic pumps 9 through 11 are each a two-way tilting swash plate mechanism hydraulic pump having a pair of inlet and outlet ports. In the second embodiment, by contrast, the first through the third hydraulic pumps 60 through 62 are each a hydraulic pump capable of forward and reverse rotations.

In FIG. 5, a power unit 54 acting as a power supply is connected electrically to the first motor generator 50 that drives the first hydraulic pump 60 for supplying the hydraulic fluid to the boom cylinder 1, the second motor generator 51 that drives the second hydraulic pump 61 for supplying the hydraulic fluid to the arm cylinder 3, the third motor generator 52 that drives the third hydraulic pump 62 for supplying the hydraulic fluid to the bucket cylinder 5, and the charge motor generator 53 that drives a charge pump 63 for supplying the hydraulic fluid to the lower-pressure line of the closed hydraulic circuit A, the power unit 54 being connected thereto via power control units 50*a* through 53*a* for controlling these motor generators 50 through 53 and via electric wiring. Electric power is exchanged between the power unit 54 on the one hand and the power control units 50*a* through 53*a* on the other hand. The power unit 54 may store the electric power coming from the power control units 50*a* through 53*a*.

The revolution speeds of the first through the third motor generators 50 through 52 and the charge motor generator 53 are controlled with the outputs from the power control units 50*a* through 53*a* responding to command signals from the controller 57. In this manner, the flow rate and the direction of suction and delivery of the hydraulic fluid by each of the first through the third hydraulic pumps 60 through 62 are controlled. When supplied with the hydraulic fluid, the first through the third hydraulic pumps 60 through 62 also function as a hydraulic motor each.

The lines coupled with the first hydraulic pump 60, second hydraulic pump 61, the third hydraulic pump 62, and the charge pump 63, and the like components are the same as those used in the first embodiment and thus will not be discussed further.

Explained below with reference to FIGS. 3 through 5 is the operation of the second embodiment of this embodiment made up of the driving device for a work machine and the work machine equipped therewith. First of all, where none of the boom control lever 56*a*, the arm control lever 56*b*, and the bucket control lever 56*c* in the non-operating state (stopped state) as shown in FIG. 3 is operated, the controller 57 outputs a stop control command signal to the power control units 50*a*, 51*a*, 52*a* and 53*a* of the first motor generator 50 that drives the first hydraulic pump 60, the second motor generator 51 that drives the second hydraulic pump 61, the third motor generator 52 that drives the third hydraulic pump 62, and the charge motor generator 53 that drives the charge pump 63, all shown in FIG. 5. At the same time, the controller 57 outputs a cut-off close command signal to the first through the third solenoid selector valves 25 through 27 of the open hydraulic circuit B and to the first through the third solenoid selector valves 37 through 39 of the open hydraulic circuit C. The controller 57 further outputs a cut-off command signal to the arm cylinder proportional selector valve 30 and the bucket cylinder proportional selector valve 42. As a result, the boom cylinder 1, the arm cylinder 3, and the bucket cylinder 5 are held in the non-operating state.

The individual operation of the boom 2 is explained next. The raising action of the boom 2 is first explained. In FIG. 5, when the operator starts operating the boom control lever 56*a* in the direction of piston rod extension, the controller 57 outputs a forward rotation torque increase command signal to the power control unit 50*a* of the first motor generator 50 and a torque increase command signal to the power control unit 53*a* of the charge motor generator 53. As a result, the first hydraulic pump 60 and the charge pump 63 are driven. Here, if the operation amount of the boom control lever 56*a* is as small as X1 as indicated at time t1 in FIG. 4, the delivery flow rate of the first hydraulic pump 60 reaches Qcp1 so that the piston rod of the boom cylinder 1 is extended at speed V1 (low speed).

At this point, in FIG. 5, the hydraulic fluid from the first hydraulic pump 60 is supplied to the head-side oil chamber 1*a* of the boom cylinder 1 via the first line 13. On the other hand, the hydraulic fluid in the rod-side oil chamber 1*b* of the boom cylinder 1 is returned to the first hydraulic pump 60 via the second line 14. At this point, the flow rate of the hydraulic fluid returning from the rod-side oil chamber 1*b* of the boom cylinder 1 to the first hydraulic pump 60 is lower than the flow rate of the hydraulic fluid supplied from the first hydraulic pump 60 to the head-side oil chamber 1*a* of the boom cylinder 1. The insufficient flow rate of the hydraulic fluid is compensated by the charge pump 63 supplying the hydraulic fluid to the first hydraulic pump 60 via the charge check valve 21 and the second line 14.

When the operator increases the operation amount of the boom control lever 56*a* to further increase the speed at which to extend the piston rod of the boom cylinder 1, the controller 57 outputs a forward rotation torque increase command signal to the power control unit 51*a* of the second motor generator 51 and a communication command signal to the third solenoid selector valve 27 of the open hydraulic circuit B. This causes the head-side oil chamber 1*a* of the boom cylinder 1 to be replenished with the hydraulic fluid sucked from the tank 18 and forwarded by the second hydraulic pump 61. Here, if the operation amount of the boom control lever 56*a* has exceeded X1 to reach X2 as indicated at time t2 in FIG. 4, the third solenoid selector valve 27 is placed in the communicating state, and the delivery flow rates of the second and the first hydraulic pumps 61 and 60 reach Qop1 and Qcp2 respectively. As a result, the hydraulic fluid flows into the head-side oil chamber 1*a* of the boom cylinder 1 at a flow rate of Qop1 Qcp2 so that the piston rod is extended at speed V2 (high speed).

When the above-described lever manipulation is performed to increase the speed at which to extend the piston rod of the boom cylinder 1, the controller 57 may output a command signal to the power control unit 52*a* of the third motor generator 52 for driving the third hydraulic pump 62 and to the third solenoid selector valve 39 of the open hydraulic circuit C, instead of issuing the command signal to the power control unit 51*a* of the second motor generator 51 for driving the second hydraulic pump 61 and to the third solenoid selector valve 27 of the open hydraulic circuit B, thereby attaining the high-speed operation.

The lowering operation of the boom 2 is explained next. Returning to FIG. 5, when the operator starts operating the boom control lever 56*a* in the direction of piston rod contraction, the controller 57 outputs a reverse rotation torque increase command signal to the power control unit 50*a* of the first motor generator 50. Here, if the operation amount of the boom control lever 56*a* is as small as −X1 as indicated at time t4 in FIG. 4, the delivery flow rate of the first hydraulic pump 60 reaches −Qcp1 causing the piston rod of the boom cylinder 1 to contract at speed −V1 (low speed).

At this point, in FIG. 5, the flow rate of the hydraulic fluid returning from the head-side oil chamber 1*a* of the boom cylinder 1 to the first hydraulic pump 60 is higher than the flow rate of the hydraulic fluid supplied from the first hydraulic pump 60 to the rod-side oil chamber 1*b* of the boom cylinder 1. The excess hydraulic fluid is returned from the first line 13 to the tank 18 via the flushing valve 20 and the line 16.

Also at this point, the pressure of the hydraulic fluid returning from the head-side oil chamber 1*a* of the boom cylinder 1 to the first hydraulic pump 60 is boosted under the empty weight of the front implement 105. When supplied with the pressurized hydraulic fluid, the first hydraulic pump 60 acts as a hydraulic motor to drive the first motor generator 50. The power generated by the first motor generator 50 in this manner is stored into the power unit 54 via the power control unit 50*a*.

When the operator raises the operation amount of the boom control lever 56*a* to further increase the speed at which to contract the piston rod of the boom cylinder 1, the controller 57 outputs a reverse rotation torque increase command signal to the power control unit 51*a* of the second motor generator 51 and a communication command signal to the third solenoid selector valve 27 of the open hydraulic circuit B. This causes the second hydraulic pump 61 to act in a manner sucking the hydraulic fluid. As a result, the discharge of the hydraulic fluid from the head-side oil chamber 1*a* of the boom cylinder 1 into the tank 18 is promoted through the communicating line 15 and the third solenoid selector valve 27.

At this point, if the operation amount of the boom control lever 56*a* has exceeded −X1 to reach −X2 as indicated at time t5 in FIG. 4, the third solenoid selector valve 27 is placed in the communicating state. At the same time, the delivery flow rates of the second and the first hydraulic pumps 61 and 60 become −Qop1 and −Qcp2 respectively. As a result, the hydraulic fluid flows from the head-side oil chamber 1*a* of the boom cylinder 1 at a flow rate of −(Qop1+Qcp2), so that the piston rod is contracted at speed −V2 (high speed). At this point, the hydraulic fluid returning from the head-side oil chamber 1*a* of the boom cylinder 1 to the second hydraulic pump 61 is highly pressurized. When supplied with the pressurized hydraulic fluid, the second hydraulic pump 61 acts as a hydraulic motor to drive the second motor generator 51. The power generated by the second motor generator 51 in this manner is stored into the power unit 54 via the power control unit 51*a*.

When the above-described lever manipulation is performed to increase the speed at which to contract the piston rod of the boom cylinder 1, the controller 57 may output an operation command signal to the power control unit 52*a* of the third motor generator 52 and to the third solenoid selector valve 39 of the open hydraulic circuit C, instead of issuing the operation command signal to the power control unit 51*a* of the second motor generator 51 and to the third solenoid selector valve 27 of the open hydraulic circuit B, thereby attaining the high-speed operation.

With this embodiment, when the lever manipulation is performed to increase the speed at which to contract the piston rod of the boom cylinder 1, the second hydraulic pump 61 and the first hydraulic pump 60 are used together to receive the hydraulic fluid flowing from the head-side oil chamber 1*a* of the boom cylinder 1, so that the operating speed of the piston rod of the boom cylinder 1 is increased.

The individual operation of the arm 4 is explained next. In FIG. 5, when the operator starts operating the arm control lever 56*b* in the direction of piston rod extension, the controller 57 outputs a forward rotation torque increase command signal to the power control unit 51*a* of the second motor generator 51, a communication command signal to the first solenoid selector valve 25 of the open hydraulic circuit B, and a forward opening command signal to the arm cylinder proportional selector valve 30. As a result, the second hydraulic pump 61 delivers the hydraulic fluid sucked from the tank 18, and the arm cylinder proportional selector valve 30 opens in the direction coupling the check valve 29 with the first line 31.

The hydraulic fluid from the second hydraulic pump 61 is supplied to the head-side oil chamber 3*a* of the arm cylinder 3 via the line 24 and the first line 31. On the other hand, the hydraulic fluid in the rod-side oil chamber 3*b* of the arm cylinder 3 is returned to the tank 18 via the second line 32, the arm cylinder proportional selector valve 30, and the line 35. As a result, the piston rod of the arm cylinder 3 is extended.

The arm damping operation is explained next. When the operator starts operating the arm control lever 56*b* in the direction of piston rod contraction, the controller 57 outputs a forward rotation torque increase command signal to the power control unit 51*a* of the second motor generator 51, a communication command signal to the first solenoid selector valve 25 of the open hydraulic circuit B, and a reverse opening command signal to the arm cylinder proportional selector valve 30. As a result, the second hydraulic pump 61 delivers the hydraulic fluid sucked from the tank 18, and the arm cylinder proportional selector valve 30 opens in the direction coupling the check valve 29 with the second line 32.

The hydraulic fluid from the second hydraulic pump 61 is supplied to the rod-side oil chamber 3*b* of the arm cylinder 3 via the line 24 and the second line 32. On the other hand, the hydraulic fluid in the head-side oil chamber 3*a* of the arm cylinder 3 is returned to the tank 18 via the first line 31, the arm cylinder proportional selector valve 30, and the line 35. As a result, the piston rod of the arm cylinder 3 is contracted.

The individual operation of the bucket 6 is performed in the same manner as that of the arm 4 and thus will not be discussed further.

The combined operation of the actuators is explained next with reference to FIGS. 3 and 5. As shown in FIG. 3, it is assumed that the boom 2, the arm 4, and the bucket 6 are operated in a combined manner. In that case, if the boom 2 is to be operated at low speed, the boom cylinder 1, the arm cylinder 3, and the bucket cylinder 5 are supplied with the hydraulic fluid respectively from the first hydraulic pump 60, the second hydraulic pump 61, and the third hydraulic pump 62 driving the respective piston rods. Specifically, the controller 57 outputs a communication command signal to the first solenoid selector valve 25 of the open hydraulic circuit B, an opening command signal to the arm cylinder proportional selector valve 30, a communication command signal to the first solenoid selector valve 37 of the open hydraulic circuit C, and an opening command signal to the bucket cylinder proportional selector valve 42.

On the other hand, if the boom 2 is to be operated at high speed, e.g., if the piston rod of the boom cylinder 1 is to be extended at a speed exceeding a predetermined threshold value, the controller 57 outputs to the power control unit 51*a* of the second motor generator 51 a forward rotation torque increase command signal corresponding to the operation amount of the boom control lever 56*a*. At the same time, controller 57 outputs a cut-off command signal to the first solenoid selector valve 25 of the open hydraulic circuit B and a communication command signal to the third solenoid selector valve 27.

As a result, the head-side oil chamber 1*a* of the boom cylinder 1 is replenished with the hydraulic fluid from the second hydraulic pump 61, so that the piston rod of the boom cylinder 1 is extended at a speed corresponding to the operation amount of the boom control lever 56*a*.

Meanwhile, the controller 57 outputs to the power control unit 52*a* of the third motor generator 52 a forward rotation torque increase command signal corresponding to the operation amount of the arm control lever 56*b*. The controller 57 also outputs a communication command signal to the second solenoid selector valve 38 of the open hydraulic circuit C. This causes the arm cylinder 3 to be supplied with the hydraulic fluid from the third hydraulic pump 62 via the arm cylinder proportional selector valve 30, whereby the piston rod of the arm cylinder 3 is drive-controlled.

When the above operation is carried out, the controller 57 may control the output of the power control unit 52*a* of the third motor generator 52 instead of the output of the power control unit 51*a* of the second motor generator 51, and may output a cut-off command signal to the first solenoid selector valve 37 of the open hydraulic circuit C and a communication command signal to the third solenoid selector valve 39 instead of the cut-off command signal to the first solenoid selector valve 25 of the open hydraulic circuit B and the communication command signal to the third solenoid selector valve 27, thereby replenishing the head-side oil chamber 1*a* of the boom cylinder 1 with the hydraulic fluid from the third hydraulic pump 62.

Where the boom 2, the arm 4, and the bucket 6 are operated in combined fashion and where the piston rod of the boom cylinder 1 is contracted at low speed, the first hydraulic motor 60 acts as a hydraulic motor to drive the first motor generator 50 as described above. The power generated by the first motor generator 50 in this manner is stored into the power unit 54 via the power control unit 50*a*.

Meanwhile, if the piston rod of the boom cylinder 1 is to be contracted at a speed exceeding a predetermined threshold value, the controller 57 outputs to the power control unit 51*a* of the second motor generator 51 a reverse rotation torque increase command signal corresponding to the operation amount of the boom control lever 56*a*. At the same time, the controller 57 outputs a cut-off command signal to the first solenoid selector valve 25 of the open hydraulic circuit B and a communication command signal to the third solenoid selector valve 27.

As a result, the second hydraulic pump 61 acts to suck the hydraulic fluid from the head-side oil chamber 1*a* of the boom cylinder 1, so that the piston rod of the boom cylinder 1 is controlled to be contracted at a speed corresponding to the operation amount of the boom control lever 56*a*. At this point, the hydraulic fluid returning to the second hydraulic pump 61 is highly pressurized. When supplied with the pressurized hydraulic fluid, the second hydraulic pump 61 acts as a hydraulic motor to drive the second motor generator 51. The power generated by the second motor generator 51 in this manner is stored into the power unit 54 via the power control unit 51*a*.

Meanwhile, the controller 57 outputs to the power control unit 52*a* of the third motor generator 52 a forward rotation torque increase command signal corresponding to the operation amount of the boom control lever 56*b*. At the same time, the controller 57 outputs a communication command signal to the second solenoid selector valve 38 of the open hydraulic circuit C. This causes the arm cylinder 3 to be supplied with the hydraulic fluid from the third hydraulic pump 62 via the arm cylinder proportional selector valve 30, whereby the piston rod of the arm cylinder 3 is drive-controlled.

When the above operation is carried out, the controller 57 may control the output of the power control unit 52*a* of the third motor generator 52 instead of the output of the power control unit 51*a* of the second motor generator 51, and may output a cut-off command signal to the first solenoid selector valve 37 of the open hydraulic circuit C and a communication command signal to the third solenoid selector valve 39 instead of the cut-off command signal to the first solenoid selector valve 25 of the open hydraulic circuit B and the communication command signal to the third solenoid selector valve 27, thereby supplying the third hydraulic pump 62 with the hydraulic fluid from the head-side oil chamber 1*a* of the boom cylinder 1.

The above-described second embodiment of the present invention made up of the driving device for a work machine and the work machine equipped therewith provides the same effects as the first embodiment discussed earlier.

Also according to the second embodiment of the present invention made up of the driving device for a work machine and the work machine equipped therewith, a hydraulic pump capable of forward and reverse rotations is used as the second hydraulic pump 61. As such, the second hydraulic pump 61 can make the flow rate of the hydraulic fluid replenishing the head-side oil chamber 1*a* of the boom cylinder 1 when the piston rod of the boom cylinder 1 is extended at high speed, substantially the same as the flow rate of the hydraulic fluid flowing from the head-side oil chamber 1*a* of the boom cylinder 1 when the piston rod of the boom cylinder 1 is contracted at high speed. As a result, the speed at which to extend and contract the piston rod of the boom cylinder 1 is made substantially the same, so that excellent operability the work machine is obtained as in the case of the first embodiment.

Further, according to the second embodiment of the present invention made up of the driving device for a work machine and the work machine equipped therewith, when the piston rod of the boom cylinder 1 is operated at low speed, the charge pump 63 and the flushing valve 20 compensate the excess or shortage of the hydraulic fluid in the flow rate balance caused by the difference in volume between the head-side oil chamber 1*a* and the rod-side oil chamber 1*b* of the boom cylinder 1. When the piston rod of the boom cylinder 1 is operated at high speed, the second hydraulic pump 61 compensates the excess or shortage of the hydraulic fluid in the flow rate balance of the boom cylinder 1 mentioned above. In this manner, in keeping with the operating speed of the piston rod of the boom cylinder 1, the use or nonuse of the second hydraulic pump 61 is selected in the closed hydraulic circuit A, which makes it possible to downsize the charge bump 63. Also, when there occur fluctuations of the pressure inside the lines during high-speed operation, the second hydraulic pump 61 provides flow rate control such as to ensure a stable operation state.

Also according to the second embodiment of the present invention made up of the driving device for a work machine and the work machine equipped therewith, the hydraulic fluid flowing from the head-side oil chamber 1*a* of the boom cylinder 1 when the piston rod of the boom cylinder 1 is contracted at high speed is guided to the first hydraulic pump 60 and the second hydraulic pump 61. This allows the displacement of the first hydraulic pump 60 to be smaller than that of its counterpart in the past.

Furthermore, according to the second embodiment of the present invention made up of the driving device for a work machine and the work machine equipped therewith, the motor generators for driving the hydraulic pumps are directly coupled thereto. As a result, the transmission losses incurred when the hydraulic pumps are driven or serve to regenerate power are smaller than in the case of the first embodiment.

The present invention is not limited to the embodiments discussed above and may also be implemented in diverse variations. The embodiments above have been explained as detailed examples helping this invention to be better understood. The present invention, when embodied, is not necessarily limited to any embodiment that includes all the structures described above.

DESCRIPTION OF REFERENCE SYMBOLS

1 Boom cylinder
1*a* Head-side oil chamber
1*b* Rod-side oil chamber
2 Boom
3 Arm cylinder
4 Arm
5 Bucket cylinder
6 Bucket
7 Engine
8 Power transmission device
9 First hydraulic pump
10 Second hydraulic pump
11 Third hydraulic pump
12 Charge pump
13 First line
14 Second line
15 Communicating line
18 Tank
20 Flushing valve
21 Charge check valve
25 First solenoid selector valve
26 Second solenoid selector valve
27 Third solenoid selector valve
30 Arm cylinder proportional selector valve
42 Bucket cylinder proportional selector valve
56*a* Boom control lever
56*b* Arm control lever
56*c* Bucket control lever
57 Controller
A Closed hydraulic circuit
B Open hydraulic circuit
C Open hydraulic circuit

The invention claimed is:

1. A driving device for a work machine, comprising:

a first hydraulic pump that has flow rate control device for controlling the flow rate and direction of hydraulic fluid to be delivered;

a first single rod hydraulic cylinder that is driven with the hydraulic fluid to drive one of work members of a work device on the work machine;

a closed hydraulic circuit that connects the first hydraulic pump with the first single rod hydraulic cylinder to form a closed circuit using a first flow line through which the hydraulic fluid flows;

a communication line that branches from the first flow line;

a second flow line of which one end is connected to the communication line;

a third flow line of which one end is connected to a tank;

a second hydraulic pump that has a first port and a second port, the first port being connected to the other end of the second flow line and the second port being connected to the other end of the third flow line, and is capable of controlling both a flow rate from the communication line to the tank and a flow rate from the tank to the communication line;

a second single rod hydraulic cylinder that drives a work member different from the one of work members;

a flow rate control valve that changes the flow rate and direction of the hydraulic fluid delivered by the second hydraulic pump, the flow rate control valve further supplying the delivered hydraulic fluid to the second single rod hydraulic cylinder;

an open hydraulic circuit that has a fourth flow line that connects the first port of the second hydraulic pump with the flow rate control valve, a fifth flow line that connects the flow rate control valve with the second single rod hydraulic cylinder, and a sixth flow line that connects the flow rate control valve with the tank; and a selector valve attached to the second flow line, the selector valve selecting either communication or cut-off of the hydraulic fluid flowing through the second flow line.

2. The driving device for the work machine according to claim 1, further comprising:

a plurality of the open hydraulic circuits;

a distribution circuit that connects the second hydraulic pump in one open hydraulic circuit with the flow rate control valve in another open hydraulic circuit using a seventh flow line; and a selector valve attached to the seventh flow line of the distribution circuit, the selector valve selecting either communication or cut-off of the hydraulic fluid in the seventh flow line.

3. The driving device for the work machine according to claim 1, wherein the second hydraulic pump includes a variable displacement device that is capable of changing the flow rate and delivery direction of the hydraulic fluid.

* * * * *